US009180503B2

(12) United States Patent
Seidel et al.

(10) Patent No.: US 9,180,503 B2
(45) Date of Patent: Nov. 10, 2015

(54) ROLL STAND FOR ROLLING A PRODUCT, IN PARTICULAR MADE OF METAL

(75) Inventors: Jürgen Seidel, Kreuztal (DE); Olaf Norman Jepsen, Siegen (DE)

(73) Assignee: SMS group GMBH, Düsseldorf (DE)

( * ) Notice: Subject to any disclaimer, the term of this patent is extended or adjusted under 35 U.S.C. 154(b) by 1060 days.

(21) Appl. No.: 13/140,124

(22) PCT Filed: Dec. 15, 2009

(86) PCT No.: PCT/EP2009/008989

§ 371 (c)(1),
(2), (4) Date: Jun. 16, 2011

(87) PCT Pub. No.: WO2010/075961

PCT Pub. Date: Jul. 8, 2010

(65) Prior Publication Data

US 2011/0289996 A1 Dec. 1, 2011

(30) Foreign Application Priority Data

Dec. 17, 2008 (DE) ..... 10 2008 062 402
May 15, 2009 (DE) ..... 10 2009 021 414

(51) Int. Cl.
*B21B 13/14* (2006.01)
*B21B 27/02* (2006.01)
(Continued)

(52) U.S. Cl.
CPC ..... *B21B 13/142* (2013.01); *B21B 27/021* (2013.01); *B21B 37/40* (2013.01); *B21B 2013/025* (2013.01); *B21B 2013/028* (2013.01)

(58) Field of Classification Search
CPC .... B21B 31/18; B21B 13/142; B21B 27/021; B21B 2013/025; B21B 2013/028; B21B 37/30; B21B 37/38; B21B 37/40; B21B 37/42; B21B 2267/18
USPC ..... 72/247, 241.2, 241.8, 252.5
See application file for complete search history.

(56) References Cited

U.S. PATENT DOCUMENTS 4,680,978 A 7/1987 Ginzburg
4,881,396 A * 11/1989 Seidel et al. ..... 72/247
4,955,221 A * 9/1990 Feldmann et al. ..... 72/247
(Continued)

FOREIGN PATENT DOCUMENTS

DE 3721746 1/1989
DE 4031666 4/1991
(Continued)

*Primary Examiner* — Shelley Self
*Assistant Examiner* — Mohammad I Yusuf
(74) *Attorney, Agent, or Firm* — Lucas & Mercanti, LLP; Klaus P. Stoffel

(57) ABSTRACT

The invention relates to a roll stand for rolling a product, in particular made of metal, comprising a pair of first rollers contacted by a pair of second rollers supporting the first rollers, wherein the first roller and the second rollers have an asymmetrical radius curve (CVC grind) relative to a center plane, wherein the radius curve of the first rollers is represented by a polynomial of the third or fifth order. In order to design the wedging of a second roller supporting a first roller such that optimal operating conditions are set, the invention proposes that the radius curve of the second roller is given by a polynomial of the third or fifth order, wherein special relationships are prescribed for the ratios between the coefficients.

14 Claims, 2 Drawing Sheets

(51) Int. Cl.
*B21B 37/40* (2006.01)
*B21B 13/02* (2006.01)

(56) References Cited

U.S. PATENT DOCUMENTS

| | | | | |
|---|---|---|---|---|
| 5,655,397 | A * | 8/1997 | Satoh et al. | 72/241.8 |
| 6,119,500 | A | 9/2000 | Ginzburg | |
| 6,192,765 | B1 | 2/2001 | Kipping | |
| 6,324,881 | B1 * | 12/2001 | Benedetti et al. | 72/247 |
| 7,059,163 | B2 | 6/2006 | Hartung et al. | |
| 7,367,209 | B2 * | 5/2008 | Ritter et al. | 72/247 |
| 7,757,531 | B2 | 7/2010 | Klockner et al. | |
| 7,913,531 | B2 * | 3/2011 | Huang et al. | 72/252.5 |
| 8,191,392 | B2 * | 6/2012 | Kikkawa | 72/252.5 |
| 8,413,476 | B2 * | 4/2013 | Seilinger et al. | 72/247 |

FOREIGN PATENT DOCUMENTS

| | | | |
|---|---|---|---|
| DE | 19732862 | | 2/1999 |
| EP | 0872290 | | 10/1998 |
| EP | 1307302 | A | 2/2007 |
| EP | 1307302 | B1 | 2/2007 |
| JP | 61296904 | | 12/1986 |
| JP | 6285518 | | 10/1994 |
| RU | 2085313 | | 7/1997 |
| WO | 0119544 | A | 3/2001 |
| WO | 2006029770 | A | 3/2006 |

* cited by examiner

ROLL STAND FOR ROLLING A PRODUCT, IN PARTICULAR MADE OF METAL

The present application is a 371 of International application PCT/EP2009/008989, filed Dec. 15, 2009, which claims priority of DE 10 2008 062 402.0, filed Dec. 17, 2008, and DE 10 2009 021 414.3, filed May 15, 2009, the priority of these applications is hereby claimed and these applications are incorporated herein by reference.

BACKGROUND OF THE INVENTION

The invention concerns a roll stand for rolling a product, especially a metal product, which has a pair of first rolls in contact with a pair of second rolls that support the first rolls, wherein the first rolls and the second rolls are provided with a radius curve (CVC cut) that is asymmetric relative to a center plane, wherein the radius curve of the first rolls is represented by a polynomial of third or fifth degree.

EP 1 307 302 B1 discloses a roll stand of this type. A polynomial curve of the specified type is provided as a radius curve in order to minimize the axial forces of the roll bearings, where suitable choice of the radius curve makes it possible to minimize horizontally acting torques without additional expense. The wedge component of the CVC work roll contour is of special importance. The configuration is carried out in such a way that the wedging of the work roll cut or work roll contour is optimized to avoid rotational torques or axial forces. The linear component of the polynomial ($a_1$) is used as an optimization parameter for this. This makes it possible to prevent crossing of the rolls and to minimize the axial forces in the roll bearings.

In this regard, the solution according to the cited document EP 1 307 302 B1 is based on a profiling of the work rolls, which interact with cylindrical backup rolls. This is the focus of the optimization of the wedging of the work rolls. Efforts have been made to expand the adjustment range of the CVC system to further increase the strip profile-adjustment range. In this connection, in order to avoid high surface pressings between work been found, however, that to optimize the wedging of the CVC contour of the backup rolls, the same configuration as for the work rolls cannot be used if the aim is to achieve optimum conditions.

SUMMARY OF THE INVENTION

Therefore, the objective of the invention is to refine a roll stand of the aforementioned type in such a way that the wedging of a second roll supporting a first ml (usually, but not exclusively: the wedging of a backup roll that is interacting with a work roll) is realized in such a way that optimum operating conditions are established.

In a first embodiment of the invention, the solution to this problem is characterized in that in a roll stand of the aforementioned type, a radius curve of the first rolls is provided that satisfies the following equation:

$$R_{AW}(x)=a_0+a_1\cdot x+a_2\cdot x^2+a_3\cdot x^3$$

where $R_{AW}(x)$: radius curve of the first roll x: coordinate in the longitudinal direction of the barrel with the origin (x=0) in the barrel center $a_0$: actual radius of the first roll $a_1$: optimization parameter (wedge factor)

$a_2$, $a_3$: coefficients (adjustment range of the CVC system)

In this connection, the following function is provided for the radius curve of the second rolls:

$$R_{SW}(x)=s_0+s_1\cdot x+s_2\cdot x^2+s_3\cdot x^3$$

where $R_{SW}(x)$: radius curve of the second roll x: coordinate in the longitudinal direction of the barrel with the origin (x=0) in the barrel center $s_0$: actual radius of the second roll $s_1$: optimization parameter (wedge factor)

$s_2$, $s_3$: coefficients (adjustment range of the CVC system)

where the following relation exists between the given variables:

$$s_1=f_1\cdot[R_{SW}/R_{AW}\cdot(b^2_{contAW}-b^2_{contSW})\cdot a_3+b^2_{contSW}\cdot s_3]$$

where $b_{contAW}$: contact length of the two first rolls $b_{contSW}$: contact length between the first and second roll or length of the second roll $f_1=-1/20$ to $-6/20$ The following relation preferably exists between the coefficients of the radius curve of the first rolls:

$$a_1=f_1\cdot a_3\cdot b^2_{contAW}$$

where $f_1=-1/20$ to $-6/20$

In an alternative solution in a roll stand of the aforementioned type, a radius curve of the first rolls is provided that satisfies the following equation:

$$R_{AW}(x)=a_0+a_1\cdot x+a_2\cdot x^2+a_3\cdot x^3+a_4\cdot x^4+a_5\cdot x^5$$

where $R_{AW}(x)$: radius curve of the first roll x: coordinate in the longitudinal direction of the barrel $a_0$: actual radius of the first roll $a_1$: optimization parameter (wedge factor)

$a_2$ to $a_5$: coefficients (adjustment range of the CVC system)

In this connection, the following function is provided for the radius curve of the second rolls:

$$R_{SW}(x)=s_0+s_1\cdot x+s_2\cdot x^2+s_3\cdot x^3+s_4\cdot x^4+s_5\cdot x^5$$

where $R_{SW}(x)$: radius curve of the second roll x: coordinate in the longitudinal direction of the barrel $s_0$: actual radius of the second roll $s_1$: optimization parameter (wedge factor)

$s_5$ to $s_5$: coefficients (adjustment range of the CVC system)

where the following relation exists between the given variables:

$$s_1=f_1\cdot[R_{SW}/R_{AW}\cdot(b^2_{contAW}-b^2_{contSW})\cdot a_3+b^2_{contSW}\cdot s_3]+f_2\cdot[R_{SW}/R_{AW}(b^4_{contAW}-b^4_{contSW})\cdot a_5+b^4_{contSW}\cdot s_5]$$

where $b_{contAW}$: contact length of the two first rolls $b_{contSW}$: contact length between the first and second roll or length of the second roll $f_1=-1/20$ to $-6/20$ $f_2=0$ to $-9/112$ In this case, the following relation preferably exists between the coefficients of the radius curve of the first rolls:

$$a_1=f_1\cdot a_3\cdot b^2_{contAW}+f_2\cdot a_5\cdot b^4_{contAW}$$

where $f_1=-1/20$ to $-6/20$ $f_2=0$ to $-9/112$

The coefficients $a_4$ and $a_5$ of the radius curve of the first rolls can be zero. In this case, the curve of the radius of the first rolls is represented as a third-degree polynomial, while the curve of the radius of the second rolls is represented as a fifth-degree polynomial.

On the other hand, it is also possible for the coefficients $s_4$ and $s_5$ of the radius curve of the second rolls to be zero. Then the curve of the radius of the first rolls is represented as a fifth-degree polynomial, while the curve of the radius of the second rolls is represented as a third-degree polynomial.

As is already known in itself, it is preferably provided that the radius curve of the first rolls is designed in such a way that the tangents that touch an end diameter and the convex part of the roll and the tangents that touch the other end diameter and the concave part of the roll are parallel to each other and are inclined to the roll axes by a wedge angle. The same applies to the radius curve $R_{SW}(x)$ of the second roll.

The first rolls are preferably work rolls, and the second rolls are preferably backup roils.

However, it is also possible for the roll stand to be a six-high stand and for the first rolls to be intermediate rolls and the second rolls backup rolls.

In general, the given linear component (wedge component), the contact length, and the diameter of the corresponding adjacent roll are taken into consideration.

An embodiment of the invention is illustrated in the drawings.

DETAILED DESCRIPTION OF THE INVENTION

Figure 1:
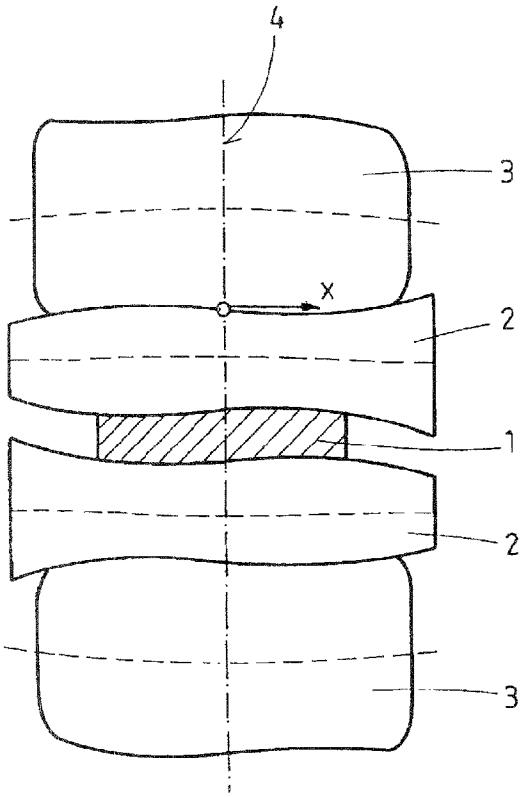
FIG. 1 is a schematic representation of a roll stand, in which rolling stock is rolled by two work rolls supported by two backup rolls.

The drawings show the conditions already known from EP 1 307 302 B1, to which reference is explicitly made in this respect. FIG. 1 shows rolling stock 1 in the form of a metal slab, which is being rolled by two first rolls 2 in the form of work rolls. The first rolls 2 are supported by second rolls 3, namely, backup rolls.

Both the work rolls 2 and the backup rolls 3 have a so-called CVC cut, i.e., the profile is asymmetric with respect to a center plane 4. Details of this are described in EP 1 307 302 B1, which was cited earlier. Accordingly, the rolls 2, 3 have a functional curve over the coordinate x in the longitudinal direction of the barrel that results from polynomials of the nth degree, with polynomials of the third or fifth degree being preferred or at least sufficient.

If the work rolls 2 are shifted axially relative to each other, the roll gap can be influenced correspondingly. The load between the work rolls 2 and the backup rolls 3 is unevenly distributed over the contact region $b_{cont}$ (see FIG. 2) and varies with the shift position of the work rolls.

Figure 2:
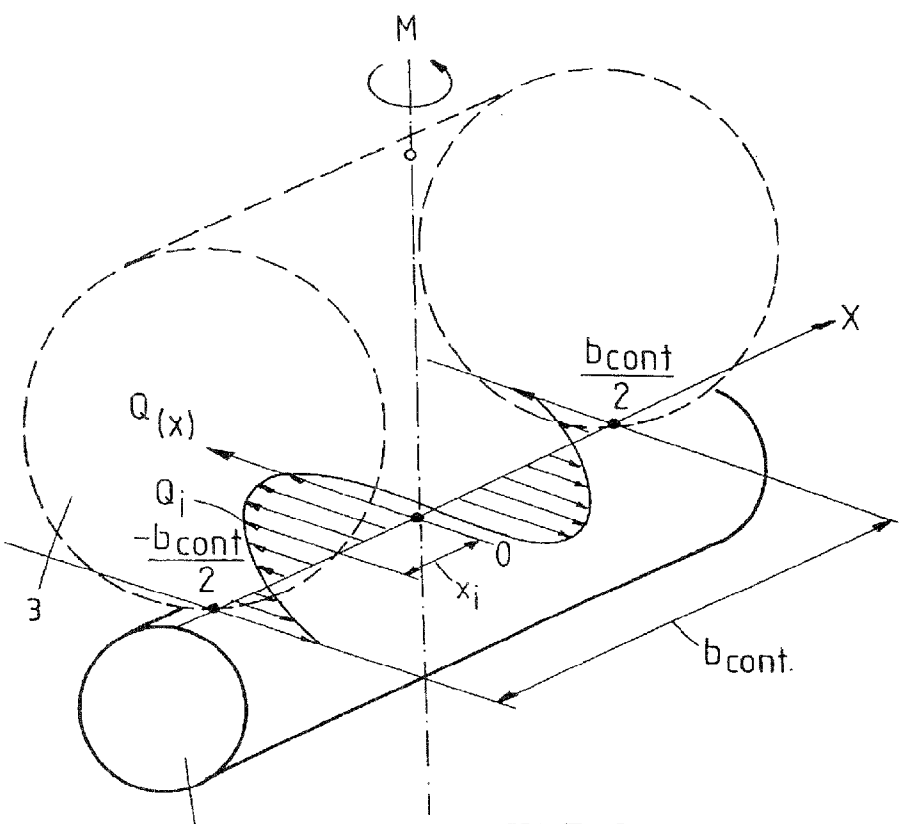
FIG. 2 is a perspective view of a work roll supported by a backup roll.

As FIG. 2 illustrates, the loads resulting from the roll shapes and the local positive or negative relative velocity lead to different peripheral forces $Q_i$ over the contact width $b_{cont}$. The distribution of the roll peripheral force $Q_i$ produces a torque M about the center of the roll stand, which can lead to crossing of the rolls and thus to axial forces in the roll bearings. This can be avoided by providing the rolls with a suitable cut. In the present case, this is done with a radius curve that is predetermined as a polynomial of the third or fifth degree.

EP 1 307 302 B1 describes the optimization of the so-called wedge factor. i.e., the coefficient of the linear term of the polynomial, for which suitable equations are proposed.

Figure 3:
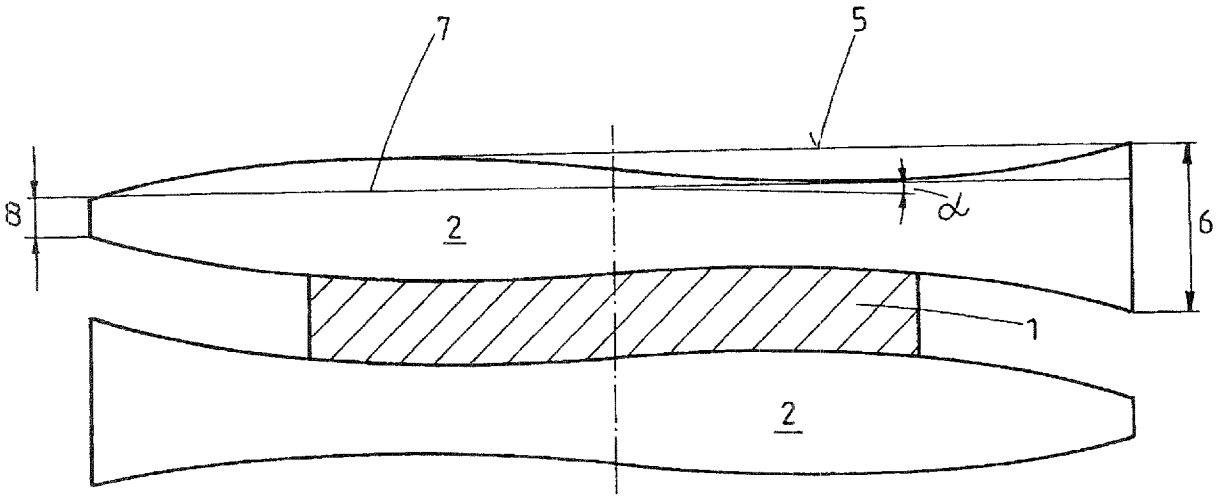
FIG. 3 shows the work rolls together with the rolling stock, as viewed in the direction of rolling.

As can be seen from FIG. 3, it is provided that the radius curve of the work rolls 2 is designed in such a way that the tangents 5 that touch an end diameter 6 and the convex part of the work roll 2 and the tangents 7 that touch the other end diameter 8 and the concave part of the work roll 2 are parallel to each other and are inclined to the roll axes by a wedge angle $\alpha$. The same applies to the radius curve of the backup rolls 3.

Accordingly, the present concept can be summarized again as follows:

The rule for the configuration of the work roll contour and the determination of the wedge component (linear coefficient of the polynomial function) is obtained according to or very similarly to the previously known EP 1 307 302 B1. The coefficients $a_2$, $a_3$, $a_4$, and $a_5$ (in the case of a fifth-degree polynomial) result from the desired adjustment range or effect in the roll gap. The contact length between the work roll and backup roll or, alternatively, the length of the work roll is to be set as the contact width for the configuration of the CVC work rolls and especially for the wedge component ($a_1$), as described in EP 1 307 302 B1. If these rules are followed, the work roll contours and especially the $a_1$ coefficient (wedge component) are optimally configured.

For the wedge component $s_1$ of the backup roll contour, which can also be described by a polynomial function, similar equations apply (which can be iteratively computed offline). The values for the wedge component $s_1$ vary as a function of the associated work roll contour and length. The shape of the backup roll thus must be adapted to the shape of the work roll. The coefficients $s_2$, $s_3$, $s_4$, and $s_5$ (in the case of representation of the backup roll contour by a fifth-degree polynomial) result from the desired adjustment range or adaptation to the S shape of the work rolls. The procedure specified above for the configuration of the backup roll contour applies here for the linear component.

For the special case that—in a representation of the radius curve as a third-degree polynomial—the backup roll does not have a CVC contour, the coefficient $s_3$ is equal to zero.

The above relationships also apply to contours that are similar to an S-shaped contour, e.g., to a so-called Smart-Crown function (sine function), or to contours that are preassigned by a point sequence and can be approximated with one of the polynomial functions specified above.

In the case of a six-high stand, the procedure can be carried out in similar fashion. In this case, the work roll is analogously configured. The configuration of the wedging of the intermediate roll is carried out as for the backup roll. After the intermediate roll is determined, the configuration of the backup roll of the six-high stand is carried out analogously to the configuration of the backup roll of the four-high stand. Generally speaking, in this regard, the given linear component, the contact length, and the diameter of the corresponding adjacent roll are taken into consideration.

In special cases, it is possible, for example, for the work roll contour to be realized by a fifth-degree polynomial function and the backup roll or intermediate roll by a third-degree polynomial function or vice versa. The mathematical relationships outlined above apply to the work rolls. For the backup rolls and intermediate rolls, the wedgings are likewise optimized by the above procedure.

The above details apply in one case for the approximation of the radius profile by a third-degree polynomial and in one case by a fifth-degree polynomial. Naturally, however, it is also basically possible to provide polynomials of higher degree, but polynomials of a degree higher than five are rarely used.

LIST OF REFERENCE NUMBERS

1 rolling stock
2 first roll (work roll)

3 second roll (backup roll)
4 center plane
5 tangent
6 end diameter
7 tangent
8 end diameter
α wedge angle

The invention claimed is:

1. A roll stand for rolling a product, comprising a pair of first rolls in contact with a pair of second rolls that support the first rolls, wherein the first rolls and the second rolls have a radius curve (CVC cut) that is asymmetric relative to a center plane, wherein the radius curve of the first rolls satisfies the following equation:

$$R_{AW}(x)=a_0+a_1\cdot x+a_2\cdot x^2+a_3\cdot x^3$$

where $R_{AW}(x)$: radius curve of the first roll
x: coordinate in the longitudinal direction of the barrel with the origin (x=0) in the barrel center
$a_0$: actual radius of the first roll
$a_1$: optimization parameter (wedge factor)
$a_2$, $a_3$: coefficients (adjustment range of the CVC system), wherein the radius curve of the second rolls satisfies the following equation:

$$R_{SW}(x)=s_0+s_1\cdot x+s_2\cdot x^2+s_3\cdot x^3$$

where $R_{SW}(x)$: radius curve of the second roll
x: coordinate in the longitudinal direction of the barrel with the origin (x=0) in the barrel center
$s_0$: actual radius of the second roll
$s_1$: optimization parameter (wedge factor)
$s_2$, $s_3$: coefficients (adjustment range of the CVC system)

where the following relation exists between the given variables:

$$s_1=f_1\cdot[R_{SW}/R_{AW}\cdot(b^2_{contAW}-b^2_{contSW})\cdot a_3+b^2_{contSW}\cdot s_3]$$

where $b_{contAW}$: contact length of the two first rolls
$b_{contSW}$: contact length between the first and second roll or length of the second roll
$f_1$=−1/20 to −6/20, wherein the wedge factors $a_1$ and $s_1$ are optimized to prevent horizontal rotational moments or axial forces, wherein the first rolls have a CVC contour configuration different from the CVC contour configuration of the second rolls.

2. The roll stand in accordance with claim 1, wherein the following relation exists between the coefficients of the radius curve of the first rolls:

$$a_1=f_1\cdot a_3\cdot b^2_{contAW}$$

where $f_1$=−1/20 to −6/20.

3. A roll stand for rolling a product, comprising a pair of first rolls in contact with a pair of second rolls that support the first rolls, wherein the first rolls and the second rolls have a radius curve (CVC cut) that is asymmetric relative to a center plane, wherein the radius curve of the first rolls satisfies the following equation:

$$R_{AW}(x)=a_0+a_1\cdot x+a_2\cdot x^2+a_3\cdot x^3+a_4\cdot x^4+a_5\cdot x^5$$

where $R_{AW}(x)$: radius curve of the first roll
x: coordinate in the longitudinal direction of the barrel
$a_0$: actual radius of the first roll
$a_1$: optimization parameter (wedge factor)
$a_2$ to $a_5$: coefficients (adjustment range of the CVC system), wherein the radius curve of the second rolls satisfies the following equation:

$$R_{SW}(x)=s_0+s_1\cdot x+s_2\cdot x^2+s_3\cdot x^3+s_4\cdot x^4+s_5\cdot x^5$$

where $R_{SW}(x)$: radius curve of the second roll
x: coordinate in the longitudinal direction of the barrel
$s_0$: actual radius of the second roll
$s_1$: optimization parameter (wedge factor)
$s_2$ to $s_5$: coefficients (adjustment range of the CVC system)

where the following relation exists between the given variables:

$$s_1=f_1\cdot[R_{SW}/R_{AW}\cdot(b^2_{contAW}-b^2_{contSW})\cdot a_3+b^2_{contSW}\cdot s_3]+f_2[R_{SW}/R_{AW}\cdot(b^4_{contAW}-b^4_{contSW})\cdot a_5+b^4_{contSW}\cdot s_5]$$

where $b_{contAW}$: contact length of the two first rolls
$b_{contSW}$: contact length between the first and second roll or length of the second roll
$f_1$=−1/20 to −6/20
$f_2$=0 to −9/112 wherein the wedge factors $a_1$ and $s_1$ are optimized to prevent horizontal rotational moments or axial forces, wherein the first rolls have a CVC contour configuration different from the CVC contour configuration of the second rolls.

4. The roll stand in accordance with claim 3, wherein the following relation exists between the coefficients of the radius curve of the first rolls:

$$a_1=f_1\cdot a_3\cdot b^2_{contAW}+f_2\cdot a_5\cdot b^4_{contAW}$$

where $f_1$=−1/20 to −6/20
$f_2$=0 to −9/112.

5. The roll stand in accordance with claim 3, wherein the coefficients $a_4$ and $a_5$ of the radius curve of the first rolls are zero.

6. The roll stand in accordance with claim 3, wherein the coefficients $s_4$ and $s_5$ of the radius curve of the second rolls are zero.

7. The roll stand in accordance with claim 1, wherein the radius curve $R_{AW}(x)$ of the first rolls and/or the radius curve $R_{SW}(x)$ of the second rolls is designed so that tangents that touch an end diameter and a convex part of the work roll and a tangents that touch the other end diameter and a concave part of the work roll are parallel to each other and are inclined to the roll axes by a wedge angle.

8. The roll stand in accordance with claim 1, wherein the first rolls are work rolls and the second rolls are backup rolls.

9. The roll stand in accordance with claim 1, wherein the roll stand is a six-high stand, the first rolls are intermediate rolls, and the second rolls are backup rolls.

10. The roll stand in accordance with claim 1, including several rolls, wherein a given linear component, a contact length, and a diameter of a corresponding adjacent roll are taken into consideration in determining the coefficients.

11. The roll stand in accordance with claim 3, wherein the radius curve $R_{AW}(x)$ of the first rolls and/or the radius curve $R_{SW}(x)$ of the second rolls is designed so that tangents that touch an end diameter and a convex part of the work roll and a tangents that touch the other end diameter and a concave part of the work roll are parallel to each other and are inclined to the roll axes by a wedge angle.

12. The roll stand in accordance with claim 3, wherein the first rolls are work rolls and the second rolls are backup rolls.

13. The roll stand in accordance with claim 3, wherein the roll stand is a six-high stand, the first rolls are intermediate rolls, and the second rolls are backup rolls.

14. The roll stand in accordance with claim 3, including several rolls, wherein a given linear component, a contact length, and a diameter of a corresponding adjacent roll are taken into consideration in determining the coefficients.

* * * * *